US005081325A

United States Patent [19]

Haynal et al.

[11] Patent Number: 5,081,325

[45] Date of Patent: Jan. 14, 1992

[54] PURIFICATION OF UNSATURATED HYDROCARBON STREAMS CONTAINING STYRENICS

[75] Inventors: Robert J. Haynal; Stewart H. Presnall; Beverly B. Slimp, Jr., both of Houston, Tex.

[73] Assignee: Lyondell Petrochemical Company, Houston, Tex.

[21] Appl. No.: 596,478

[22] Filed: Oct. 12, 1990

[51] Int. Cl.[5] ..... C07C 7/12

[52] U.S. Cl. ..... 585/820; 585/822; 585/823

[58] Field of Search ..... 585/822, 820, 836, 850, 585/852, 854, 823

[56] References Cited

U.S. PATENT DOCUMENTS 4,243,831 1/1981 Malloy et al. ..... 585/820

4,795,545 1/1989 Schmidt ..... 585/822

OTHER PUBLICATIONS

Grant and Hackh's Chemical Dictionary, 5th ed., McGraw-Hill Book Co., 1987, p. 60.

Oil-Dri Products Sheets for Ultra-Clear ® 30/60 attapulgite (Mar. 1988).

*Primary Examiner*—Anthony McFarlane

*Assistant Examiner*—Nhat Phan

*Attorney, Agent, or Firm*—Arnold, White & Durkee

[57] ABSTRACT

This invention relates to a method for removing polar bodies and other contaminants, including color bodies, from unsaturated hydrocarbon streams having a boiling range between 280°-310° F. by contacting the unsaturated hydrocarbon stream with a neutral clay comprising an oxide state of at least one and preferably two of Si, Al, Fe, Ca, Mg, K, Na, S, and P, particularly attapulgite clay. The process is most effective if the unsaturated hydrocarbon stream is first dried using a molecular sieve.

25 Claims, No Drawings

PURIFICATION OF UNSATURATED HYDROCARBON STREAMS CONTAINING STYRENICS

BACKGROUND OF THE INVENTION

This invention relates to a process for removing polar bodies and contaminants, including color bodies, from unsaturated hydrocarbon streams having a boiling range between 280°-310° F. derived from the cracking of petroleum and coal (such streams hereinafter are called "unsaturated hydrocarbon streams"). Unsaturated hydrocarbon streams contain a number of contaminants and polar bodies which affect their color and purity, including color bodies, unwanted preformed polymers, sulfur containing compounds, compounds containing oxygen (hereinafter called oxygenates), including but not limited to aldehydes, ketones, peroxides, tetrahydrofurans, furans, ethers, including glycol ethers, hydroxy compounds, including phenols, glycols, catechols, resorcinol, hydroquinones, and other oxygenates, including but not limited to alcohols, glycols, phenolics, and hydroxybenzenes.

An important component of unsaturated hydrocarbon streams in the 280°-310° F. boiling range is styrene. Styrene is used in a wide variety of applications. For example, styrene is used to manufacture polystyrene products, such as cups, plates, packaging materials, and insulation. Important characteristics sought in a commercial styrene product are purity and lack of color. Thus, companies that produce styrene are under pressure to rid their styrene products of contaminants that increase the color or reduce the purity of the styrene. Styrene producers also are under pressure to rid their styrene products of contamination by sulfur, which can cause an unpleasant odor or undesirable color, and which can poison and/or consume catalysts used in subsequent reactions to which the styrene may be subjected.

Styrene is one product resulting from the refinement of petroleum crude oil. For example, styrene is a byproduct in the thermal pyrolysis of hydrocarbon streams, particularly naphthas and distillates derived from crude oil, to produce ethylene and propylene. The styrene is recovered as part of a pyrolysis gasoline product, consisting of organic molecules having five to nine carbon atoms, and having a boiling range of 280°-310° F. This styrene-rich gasoline stream can be treated according to the present invention. Styrene also is produced at other points in the petroleum refining process. See U.S. Pat. Nos. 3,684,665; 4,031,153; and 3,763,015; also Sato, M. Extract Styrene from Pyrolysis Gasoline. Hydrocarbon Processing (May 1973) 141-144. In addition, styrene can be obtained from the pyrolytic treatment of coal, for example, through destructive distillation. Additionally, the styrene referred to herein can be styrene intentionally produced such as by a manufacturing process from benzene and ethylene feedstocks or similar feedstocks. Further styrene produced by the dehyrogenation of ethyl benzene or dehydration of α-methyl benzyl alcohol (α-MBA) can be used herein.

Various methods of purifying such unsaturated hydrocarbon streams have been tried in the past; however, there is a need for an inexpensive, commercially feasible method for purifying such streams.

SUMMARY OF THE INVENTION

The present invention addresses the above problem by providing a less expensive, effective method for purifying such unsaturated hydrocarbon streams while minimizing the amount of solid waste that is generated.

It has been discovered that polar bodies and other contaminants present in such unsaturated hydrocarbon streams can be removed by contacting the stream with an adsorbent, particularly a "neutral" clay having at least one and preferably two oxide states of Si, Al, Fe, Ca, Mg, K, Na, S, and P. The preferred clay for use in the invention is attapulgite clay. The present invention is most effective when the unsaturated hydrocarbon stream is first contacted with a molecular sieve.

DETAILED DESCRIPTION OF THE INVENTION

For purposes of simplicity, the removal of polar bodies, color bodies, and other contaminants from unsaturated hydrocarbon streams according to the present invention hereinafter will be referred to as "purifying" or "purification" of the stream. A stream that has been treated using the present invention will be referred to as a "purified" unsaturated hydrocarbon stream. The purity of an unsaturated hydrocarbon stream treated according to the present invention is measured using a method known in the art as the American Public Health Association ("APHA") system. Am. Soc. of Testing Materials Vol. 06.01, p. 146, D1209-84. Standard test method for color of clear liquids (platinum-cobalt scale), incorporated herein by reference. An unsaturated hydrocarbon stream that is obtained directly from a resin oil tower generally has an APHA measurement of about 627. Treatment of the stream according to the present invention is considered to be successful if the APHA number is reduced to 50, preferably to less than 50. The lower the APHA number, the more successful the treatment. The treatment of a hydrocarbon stream also is considered to be successful if the percent of styrenics in the resulting purified unsaturated hydrocarbon stream does not fall below 50%, preferably remaining above 60% or more.

The preferred adsorbent for use in the present invention is clay. Acidic clays, especially acid treated clays that have not been neutralized in some manner, are not believed to be useful in the present invention because they tend to polymerize styrenic and other olefinic molecules, and the polymerized molecules then clog the pores of the clay and interfere with the purification process. In addition, such acid treated clays have been observed to generate exothermic reactions which interfere with the functioning of the invention.

A clay is believed to be useful in this invention if, when 5 gm of the clay is mixed with 10 gm of distilled water and shaken, the pH of the resulting mixture is between 5-9, particularly between 6-8, and most particularly 7. Such clays herein are called "neutral" clays. All neutral clays derived from transition metals should be useful in the present invention, such as clays derived from the oxide states of Si, Al, Fe, Ca, Mg, K, Na, S, and P, and mixtures thereof. For example, clays with an ultimate analysis containing $SiO_2$, $Al_2O_3$, $Fe_2O_3$, CaO, MgO, $K_2O$, $Na_2O$, $SO_3$, and $P_2O_5$ should be useful in the invention. Combinations of two or more of such clays are particularly useful in the invention. Hydrated silicates of aluminum, iron, or magnesium are suited for use in the invention. In particular, the clay that has been found to be most effective in the present invention is attapulgite clay.

Usable clays have a mesh between approximately 4-300, preferably between 30-60. Those of skill in the art will recognize that, as the mesh of the clay increases, the amount of processing necessary to purify the stream can be varied. Clays useful in the invention can be obtained from a number of sources, such as Oil Dri Corporation of America, 520 North Michigan Avenue, Chicago, Ill., 60611. Heating of the clay before use, e.g. by kilning, can be helpful to remove unwanted moisture; however, the clay should not be heated above 800° C., or the clay particles may fuse and clog, rendering the clay ineffective to purify the unsaturated hydrocarbon stream.

Purification of unsaturated hydrocarbon streams according to the present invention has been found to be most effective when the stream first is contacted briefly with a molecular sieve, particularly a 13× molecular sieve composed of alumina silicate. Such molecular sieves can be obtained from Davison Chemical, a Division of Grace Chemical, Baltimore, Md., 21203. Other molecular sieves, such as 4A and 5A molecular sieves, are preferred to remove water and then preferentially, a 13× molecular sieve can be used to remove water and color bodies conjunctively. Contacting the stream with a series of molecular sieves of increasing mesh size also may be an effective mode of practicing the invention.

Molecular sieves are used to remove water from the unsaturated hydrocarbon stream. Water may block the active sites in the adsorbent which are responsible for purification of the stream. Certain molecular sieves, such as the 13× molecular sieve obtained from Davison Chemical, also can remove polar bodies and other contaminants according to the present invention; however, such molecular sieves are less effective and much more expensive than other adsorbents that are useful in the invention. Thus, such molecular sieves are not as efficient or economically desirable on a large scale as other, less expensive adsorbents.

Treatment of unsaturated hydrocarbon streams according to the present invention also removes sulfur containing compounds from the stream. Sulfur containing compounds can cause the hydrocarbon stream to have a variety of characteristics, such as color forming bodies, an unpleasant odor, and, because sulfur is reactive, sulfur containing compounds can poison and/or consume catalysts used in subsequent reactions to which the stream may be subjected.

Adsorbents used to purify unsaturated hydrocarbon streams according to the present invention have been found to be effective, without regeneration, up to approximately an 8:1 weight to weight ratio. For example, 100 gms of attapulgite clay are effective to clarify 800 gms of unsaturated hydrocarbon stream. After this 8:1 ratio has been met, the clay either must be disposed of or regenerated. An efficient and economically feasible method to regenerate the adsorbent after use so that it can be reused to purify unsaturated hydrocarbon streams at approximately an 8:1 ratio for at least 7 additional times, or eight times total, to result in a 64:1 weight to weight ratio has been discovered. No decrease in effectiveness of the clay was noted after 8 regenerations; therefore, it may be possible to regenerate the clay indefinitely. Such regeneration greatly reduces the problem of disposal of spent clay after use. Regeneration of clay after its use to remove contaminants from petroleum products is the subject of copending patent application Ser. No. 596,517.

The invention will be more clearly understood with reference to the following examples:

EXAMPLE 1

90 g of an unsaturated hydrocarbon stream containing 63.5028% of styrenics and having an APHA number of 627 were passed through a separatory funnel containing a 13× molecular sieve obtained from Davison Chemical, a Division of Grace Chemical, Baltimore, Md., 21203 for a total average residence time of approximately 10 minutes. The effluent from the separatory funnel was passed through a column containing 15 g of attapulgite clay obtained from Oil Dri Corporation of America, 520 North Michigan Avenue, Chicago, Ill., 60611. After 15 minutes average residence time, the effluent was collected and the APHA number was measured at 40, the styrenic content at 63.0801%.

EXAMPLE 2

70 g of an unsaturated hydrocarbon stream containing 63.5028% of styrenics and having an APHA number of 627 were passed through a separatory funnel containing a 13× molecular sieve obtained from Davison Chemical, a Division of Grace Chemical, Baltimore, Md., 21203 for a total average residence time of about 10 minutes. The effluent from the separatory funnel was passed through a column containing 10 g of attapulgite clay obtained from Oil Dri Corporation of America. After 15 minutes average residence time, the effluent was collected and the APHA number was measured at 40, the styrenic content at 63.1701%.

A simple gravity driven or batch procedure can be used, or a pump or ebullient bed can be used to force the unsaturated hydrocarbon stream through the adsorbent. The resulting purified stream can be collected by any known method, including, for example, collection in a pipeline so that the resulting stream can be transferred to another location.

While the invention has been described with respect to various specific examples and embodiments, it is to be understood that the invention is not limited thereto. Many variations and modifications may be made upon the specific examples disclosed herein, and the appended claims are intended to cover all of these variations and modifications.

What is claimed is:

1. A process for removing polar bodies from an unsaturated hydrocarbon stream having a boiling range between 280°-310° F. comprising the steps of contacting said unsaturated hydrocarbon stream with an adsorbent consisting essentially of a neutral attapulgite clay for a time sufficient to purify said unsaturated hydrocarbon stream, and collecting a purified unsaturated hydrocarbon stream.

2. A process for removing contaminants from an unsaturated hydrocarbon stream having a boiling range between 280°-310° F. comprising the steps of contacting said unsaturated hydrocarbon stream with an adsorbent consisting essentially of a neutral attapulgite clay for a time sufficient to purify said unsaturated hydrocarbon stream, and collecting a purified unsaturated hydrocarbon stream.

3. The process of claim 1 wherein said unsaturated hydrocarbon stream is first contacted with a molecular sieve.

4. The process of claim 2 wherein said unsaturated hydrocarbon stream is first contacted with a molecular sieve.

5. The process of claim 3 wherein said molecular sieve is 13×.

6. The process of claim 4 wherein said molecular sieve is 13×.

7. The process of claim 1 wherein said process removes sulfur containing compounds from said unsaturated hydrocarbon stream.

8. The process of claim 2 wherein said process removes sulfur containing compounds from said unsaturated hydrocarbon stream.

9. A process for reducing the APHA reading of an unsaturated hydrocarbon stream having a boiling range between 280°-310° F., said APHA reading is determined by the American Public Health Association System said process comprising the steps of contacting said unsaturated hydrocarbon stream with an adsorbent consisting essentially of a neutral attapulgite clay for a time sufficient to reduce the APHA reading of said unsaturated hydrocarbon stream to 50 or less, and collecting said purified unsaturated hydrocarbon stream.

10. The process of claim 9 wherein said unsaturated hydrocarbon stream is first contacted with a molecular sieve.

11. The process of claim 10 wherein said molecular sieve is 13×.

12. The process of claim 9 wherein said process removes sulfur containing compounds from said unsaturated hydrocarbon stream.

13. A purified unsaturated hydrocarbon stream having a boiling range between 280°-310° F. produced by a process for purifying an unsaturated hydrocarbon stream comprising the steps of contacting said unsaturated hydrocarbon stream with a neutral clay for a time sufficient to purify said unsaturated hydrocarbon stream, and collecting said purified unsaturated hydrocarbon stream.

14. The product of claim 13 wherein during said process, said unsaturated hydrocarbon stream is first contacted with a molecular sieve.

15. The product of claim 14 wherein said molecular sieve is 13×.

16. The product of claim 13 wherein said process removes sulfur containing compounds from said unsaturated hydrocarbon stream.

17. A purified unsaturated hydrocarbon stream having a boiling range between 280°-310° F. produced by a process for reducing the APHA reading of an unsaturated hydrocarbon stream, said APHA reading is determined by the American Public Health Association System said process comprising the steps of contacting said unsaturated hydrocarbon stream with an adsorbent consisting essentially of a neutral attapulgite clay for a time sufficient to reduce the APHA reading of said unsaturated hydrocarbon stream 50 or less, and collecting said purified unsaturated hydrocarbon stream.

18. The product of claim 17 wherein during said process, said unsaturated hydrocarbon stream is first contacted with a molecular sieve.

19. The product of claim 18 wherein said molecular sieve is 13×.

20. The product of claim 17 wherein said process removes sulfur containing compounds from said unsaturated hydrocarbon stream.

21. The process of claim 1 wherein the purified unsaturated hydrocarbon streams comprise in major part styrenics.

22. The process of claim 2 wherein the purified unsaturated hydrocarbon streams comprise in major part styrenics.

23. The process of claim 9 wherein the purified unsaturated hydrocarbon streams comprise in major part styrenics.

24. The purified unsaturated hydrocarbon stream of claim 17 which comprises in major part styrenics.

25. The process of claim 9 wherein the ratio of the APHA reading of the initial unsaturated hydrocarbon stream and the purified hydrocarbon stream is about 15:1.

* * * * *